US007956835B2

(12) United States Patent
Tsuyuki et al.

(10) Patent No.: US 7,956,835 B2
(45) **Date of Patent: *Jun. 7, 2011**

(54) DISPLAY DEVICE

(75) Inventors: Takashi Tsuyuki, Sagamihara (JP); Hiroyuki Takahashi, Funabashi (JP)

(73) Assignee: Hitachi Displays, Ltd., Chiba (JP)

( * ) Notice: Subject to any disclaimer, the term of this patent is extended or adjusted under 35 U.S.C. 154(b) by 686 days.

This patent is subject to a terminal disclaimer.

(21) Appl. No.: 12/034,870

(22) Filed: Feb. 21, 2008

(65) Prior Publication Data

US 2008/0150870 A1 Jun. 26, 2008

Related U.S. Application Data

(63) Continuation of application No. 10/704,713, filed on Nov. 12, 2003, now Pat. No. 7,336,252.

(30) Foreign Application Priority Data

Nov. 15, 2002 (JP) ..... 2002-331668

(51) Int. Cl.
*G09G 3/36* (2006.01)

(52) U.S. Cl. ..... 345/96; 345/1.1; 345/209; 455/566

(58) Field of Classification Search ..... 345/87, 345/98, 99, 100, 204, 209, 1.1, 1.2, 1.3
See application file for complete search history.

(56) References Cited

U.S. PATENT DOCUMENTS

| | | | |
|---|---|---|---|
| 6,545,655 | B1 | 4/2003 | Fujikawa |
| 6,583,770 | B1 | 6/2003 | Antila et al. |
| 6,624,801 | B2 | 9/2003 | Moriyama |
| 7,184,012 | B1 | 2/2007 | Kim |

FOREIGN PATENT DOCUMENTS

| | | |
|---|---|---|
| JP | 2001-067049 | 3/2001 |

*Primary Examiner* — Duc Q Dinh
(74) *Attorney, Agent, or Firm* — Antonelli, Terry, Stout & Kraus, LLP.

(57) ABSTRACT

An image display device includes a first display panel having a substrate with first scanning lines, first signal lines which intersect the first scanning lines, and first switching elements, a second display panel having another substrate with second scanning lines, second signal lines which intersect the second scanning lines, and second switching elements, and a flexible printed circuit board connecting the first display panel with the second display panel. The image display device drives the first display panel in a line inversion mode when only the first display panel displays images, drives the second display panel in a frame inversion mode when only the second display panel displays images, and drives the first display panel and the second display panel in the line inversion mode when both of the first display panel and second display panel display images.

8 Claims, 8 Drawing Sheets

DISPLAY DEVICE

CROSS REFERENCE TO RELATED APPLICATION

This application is a continuation application of U.S. application Ser. No. 10/704,713, filed Nov. 12, 2003, now U.S. Pat. No. 7,336,252, the contents of which are incorporated herein by reference.

BACKGROUND OF THE INVENTION

The present invention relates to an image display device; and, more particularly, the invention relates to an image display device which includes display devices having two display screens of different display data quantities and which can perform a display of images on respective display devices alternatively or simultaneously.

With respect to miniaturized equipment, such as a portable information terminal, including a mobile telephone or the like, it is expected that good availability and power saving can be achieved by providing a first screen which displays simple information, such as the indication of time, status information or manipulation information involving the equipment separate from a second screen for displaying main, more useful information, such as communication information, content information and the like. For example, in a standby state of equipment having individual screens on two surfaces of a body thereof, such as a folding type portable telephone, by setting in an operable state only the screen having a small size and low power consumption, because it is used to display only a small display data quantity, and by operating the other screen to display the required display data quantity in transmitting and receiving communication information, low power consumption can be achieved as a whole.

Conventionally, in an image display device of this type having two separate screens, the display devices which constitute the respective screens are operated using individual signal drive circuits. However, in order to incorporate two display devices which are driven independently from each other in a mobile telephone or the like, the inner volume of a limited housing of such a device is restricted, and, at the same time, a circuit which drives the driving circuits provided for the respective devices in response to states of use thereof becomes necessary, and, hence, the circuit constitution becomes complicated and drives up the cost.

To cope with such a situation, it may be possible to realize a miniaturization, reduction of weight and low power consumption in equipment in which the image display device is mounted by adopting a common use of the signal line drive circuit. For example, with respect to the liquid crystal display device described in patent literature 1 (Japanese Unexamined Patent Publication 2001-67049), first and second liquid crystal display panels, which differ in the number of signal lines displayed thereon, are used as two display devices which have different display capacities (number of signal lines), wherein the signal lines of the liquid crystal display panel with a large display capacity are extended to the liquid crystal display panel having the signal lines with a small display capacity to allow the common use of these extended lines, whereby the respective liquid crystal display panels are driven using a common signal line drive circuit.

BRIEF SUMMARY OF THE INVENTION

However, in the above-mentioned image display device, since some signal lines of the first display device having the large display capacity are extended and are used in common with the signal lines of the second display device having the small display capacity, the first display device and the second display device differ from each other with respect to the line resistance of the signal lines, the floating capacity, the pixel capacity (liquid crystal capacity in case the image display device is a liquid crystal display device) or the like. Accordingly, in producing a display on a display area of the first display device, a so-called vertical smear is generated at a boundary between a display portion of signal lines which are used in common with the second display device and a display portion of the other signal lines, and, hence, the image quality is deteriorated. The solution of this problem has been one of the tasks to be solved heretofore.

Accordingly, it is an object of the present invention to provide an image display device of low power consumption which uses signal lines driven by a common drive circuit, which is shared between first and second display devices in common and performs display of images alternatively or simultaneously using these two display devices, whereby the image display device can realize an image display of high quality by suppressing the generation of the above-mentioned vertical smear in the first display device, along with the realization of low power consumption.

According to one aspect of the present invention, a liquid crystal display device includes a first display device in which a plurality of first scanning lines and a plurality of first signal lines are arranged in a matrix array on a substrate, and a plurality of first pixels having first switching elements are formed on intersecting portions of the first scanning lines and the first signal lines; a second display device in which a plurality of second scanning lines and a plurality of second signal lines are arranged in a matrix array on a substrate, and a plurality of second pixels having second switching elements are formed on intersecting portions of the second scanning lines and the second signal lines; and a display control device which controls display operations of the first display device and the second display device. In this display device, wherein the number of the second signal lines of the second display device is smaller than the number of the first signal lines of the first display device, the second signal lines of the second display device are connected to the first signal lines of the first display device, the display control device displays images by driving the first display device in a first display mode, and it displays images by driving the second display device in either one of the first display mode and the second display mode.

According to another aspect of the present invention, in a liquid crystal display device which includes two display devices constituted of a first display device and a second display device, which is formed of signal lines smaller in number than the number of signal lines of the first display device, the signal lines which are driven by a common drive circuit are used in common by the first and the second display devices, whereby the two display devices alternatively or simultaneously perform an image display. When the image display is performed by only the first display device or when the image displayed is performed by two display devices constituted of the first display device and the second display device, an N-line (N being an integer of 1 or more) inversion drive mode is adopted, and when the image display is performed by only the second display device, a frame inversion drive mode is adopted.

Due to such constitutions, by performing the N-line inversion drive mode, that is, the N-line alternating drive, it is possible to suppress vertical smear which is generated at the first display device side due to the influences of the pixel capacity, the wiring resistance and the like of the second display device, when the display is performed using only the first display device or when the display is performed using the first display device and the second display device. Further, when display is performed using only the second display device, by changing over the display mode to the frame inversion drive mode, that is, the frame alternating drive, the power consumption can be suppressed.

By integrating the drive circuits for respectively driving the first and the second display devices into one drive circuit, the constitution of the device can be simplified. Further, by changing over the display mode at the second display device, which is constituted of the small number of signal lines, to the frame inversion drive mode, low power consumption can be realized.

Here, it is needless to say that the present invention is not limited to the above-mentioned constitution and the constitutions of embodiments described later, and that various modifications can be made without departing from the technical concept of the present invention. In this regard, the present invention is applicable in the same manner to an active matrix type liquid crystal display device and an organic EL display device, which use thin film transistors as active elements, and other known image display devices using active elements.

DESCRIPTION OF THE PREFERRED EMBODIMENTS

Figure 1:
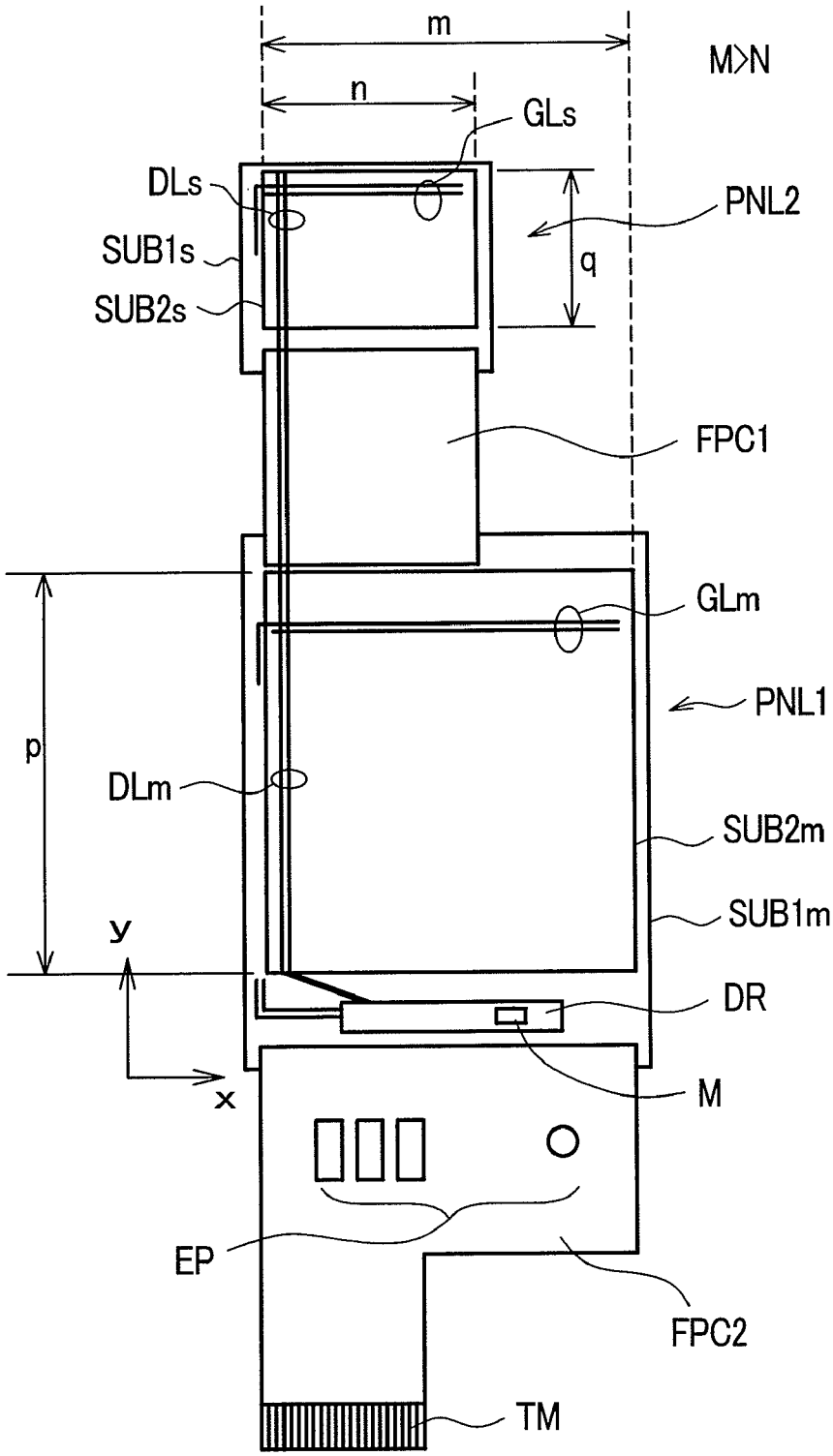
FIG. 1 is a plan view schematically illustrating the constitution of one embodiment of an image display device according to the present invention.

Hereinafter, specific embodiments of the present invention will be explained in detail in conjunction with the drawings. In the drawings which are referred to in the explanation, parts which have identical functions are given the same reference symbols, and a repeated explanation of these parts will be omitted to the extent possible. Here, the explanation of the present invention will be directed to a liquid crystal display device using thin film transistors as active elements, as an example.

FIG. 1 is a plan view schematically illustrating one embodiment of the image display device according to the present invention.

In the drawings, reference symbol PNL1 indicates a first display device, wherein the first display device PNL1 is constituted by sandwiching a liquid crystal layer between a first substrate SUB1*m* and a second substrate SUB2*m*. On a main surface of the first substrate SUB1*m*, that is, on an inner surface of the first substrate SUB1*m* which faces the second substrate SUB2*m*, there are a plurality of signal lines (also referred to as data lines or drain lines) DLm, which extend in the vertical direction (hereinafter referred to as y direction) and are arranged in parallel in the horizontal direction (hereinafter referred to as x direction). Further, on the main surface of the first substrate SUB1*m*, that is, on the inner surface of the first substrate SUB1*m* which faces the second substrate SUB2*m*, there are a large number of scanning lines (gate lines) GLm, which extend in the x direction and are arranged in parallel in the y direction.

Reference symbol PNL2 indicates a second display device, wherein a liquid crystal layer is sandwiched between a first substrate SUB1*s* and a second substrate SUB2*s*. On a main surface of the first substrate SUB1*s*, that is, on an inner surface of the first substrate SUB1*s* which faces the second substrate SUB2*s*, there are a plurality of signal lines (also referred to as data lines or drain lines in the same manner as the above) DLs, which extend in the y direction and are arranged in parallel in the x direction. These signal lines DLs are connected to some (a plurality of lines arranged at the left side in FIG. 1) of the signal lines DLm of the first display device PNL1. The signal lines DLs are formed in a state such that the signal lines DLs extend by way of a flexible printed circuit board FPC1. Further, on the main surface of the first substrate SUB1*s*, that is, on the inner surface of the first substrate SUB1*s* which faces the second substrate SUB2*s*, there are a large number of gate lines GLs, which extend in the x direction and are arranged in parallel in the y direction. These gate lines GLs are wired such that they are pulled around the first substrate SUB1*m* of the first display device PNL1 by way of the flexible printed circuit board FPC1.

The gate lines GLs of the second display device PNL2 and the gate lines GLm of the first display device PNL1 are driven by a scanning line drive circuit that is incorporated in a drive circuit DR. The number of the gate lines GLs, which are provided to the second display device PNL2, is smaller than the number of gate lines GLm which are provided to the first display device PNL1. In this embodiment, although the present explanation is made on the premise that the resolutions (definitions) of the first and the second display devices are equal, while the screen size of the second display device PNL2 is smaller than the screen size of the first display device PNL1, there may be a case in which the resolution of the second display device is coarse, or, to the contrary, there may be a case in which the second display device exhibits a finer definition than the first display device.

Here, the number n of the signal lines DLs which are provided to the second display device PNL2 is smaller than the number m of the signal lines DLm which are provided to the first display device PNL1 ($n<m$). Further, the number q of the gate lines GLs which are provided to the second display device PNL2 is smaller than the number p of the scanning lines GLm which are provided to the first display device PNL1 ($q<p$). Accordingly, provided that the definition is equal, the display screen size of the second display device PNL2 becomes smaller than the display screen size of the first display device PNL1.

On a side of a portion (lower side in FIG. 1) of the first substrate SUB1*m* of the first display device PNL1 in the x direction, which is not covered with the second substrate SUB2*m*, a drive circuit (semiconductor chip) DR is mounted. The drive circuit DR incorporates a signal line drive circuit and a scanning line drive circuit in one chip. Further, the drive circuit DR incorporates a frame memory (image memory GRAM)M therein, wherein the frame memory has a capacity corresponding to at least the display capacity of the first display device PNL1. Although the drive circuit DR is mounted using a so-called chip-on-glass (COG) mounting, the drive circuit DR may be directly built in the first substrate SUB1*m*.

The signal line drive circuit DR supplies the scanning signals (gate signals) to the scanning lines GLm of the first display device PNL1 and to the scanning lines GLs of the second display device PNL2. That is, the signal line drive circuit has terminals for supplying the gate signals to both of the scanning lines GLm of the first display device PNL1 and to the scanning lines GLs of the second display device PNL2.

In the drive circuit DR, there are a timing converter which generates timing signals or the like for displaying image data to the first display device PNL1 and the second display device PNL2 in response to various timing signals, including image data and clock signals inputted from an external signal source (a host-side CPU or the like) through a flexible printed circuit board FPC2, and an image memory M which stores the image data. Here, electronic parts, such as resistors, capacitors and the like, or a power source circuit (semiconductor chip) EP are mounted on the flexible printed circuit board FPC2.

The first display device PNL1 and the second display device PNL2 are connected by the flexible printed circuit board FPC1 that is disposed therebetween, and the scanning signals and the image signals (gray scale signals) from the drive circuit DR are supplied to the first display device PNL1 and the second display device PNL2. Further, on inner surfaces of the respective second substrates SUB2*m*, SUB2*s* of the first display device PNL1 and the second display device PNL2, color filters in three colors (RGB) and common electrodes are formed, wherein a common electrode voltage is applied to the common electrodes. The color filters and the common electrodes are omitted from the drawing.

In the constitution of the embodiment shown in FIG. 1, some of the signal lines DLm in the first display device PNL1 are formed in common with the signal lines DLs of the second display device PNL2, and these lines are driven by the drive circuit DR. The drive circuit DR drives the first display device PNL1 and the second display device PNL2 to alternatively or simultaneously perform the display of images. When the images are displayed using only the first display device PNL1, the image display device is driven in an N-line (N being 1 or integer) inversion drive mode (N-line AC drive mode). Further, when the images are displayed using both the first display device PNL1 and the second display device PNL2, the image display device is also driven in an N-line inversion drive mode in the same manner. To the contrary, when the images are displayed using only the second display device PNL2, the display is performed in an inversion drive mode (frame alternating drive mode).

Figure 2:
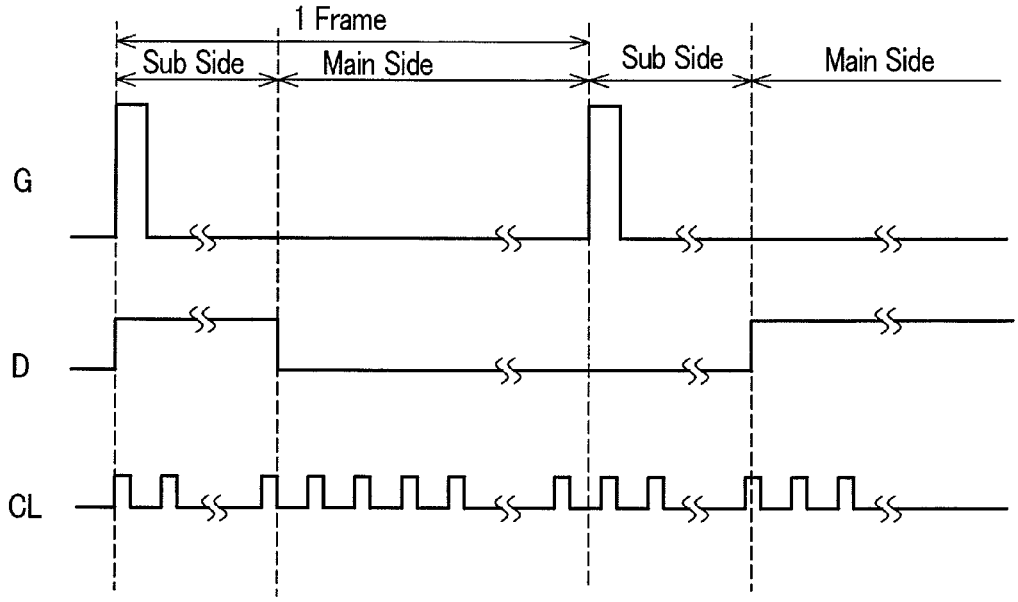
FIG. 2 is a waveform chart showing main signals outputted from a drive circuit in a frame inversion drive mode in the embodiment of the present invention.

FIG. 2 is a waveform chart showing main signals outputted from the drive circuit in the frame inversion drive mode in the embodiment of the present invention. In FIG. 2, a waveform G indicates an output signal to the scanning lines, a waveform D indicates an output signal to the signal lines, and a waveform CL indicates a line clock signal output. In producing an image display on the first display device PNL1 and the second display device PNL2, the output signals D (gray scale voltages) are supplied to the signal lines of the pixels having active elements (thin film transistors or the like, referred to as thin film transistors hereinafter) which are connected to the signal lines selected in response to the line clock signal CL in synchronism with the output signal G to the scanning lines. This output signal D is fetched into respective pixels at a pixel clock (not shown in the drawing) and image display is performed.

When image display is performed using only the second display device PNL2, as shown in FIG. 2, in the frame inversion drive mode, one image frame stored in the frame memory M, which is incorporated in the drive circuit DR, is inverted between a display period (described as a sub side in the drawing) of the second display device PNL2, which is a period corresponding to the number DLs of the signal lines in the second display device PNL2, and a display period (described as a main side in the drawing) of the first display device PNL1, which is a period corresponding to the number DLm of the signal lines in the first display device PNL1. Then, in the next frame, the polarity of the output signal D of the display data is further inverted at the sub side and the main side. Here, the output signal D to the signal lines DLm in the first display device PNL1 is referred to as a "black" signal.

Due to such a constitution, when image display is performed using only the second display device PNL2, by adopting the frame inversion drive mode, that is, the frame alternating drive, the operation of the image display device is set free from the influence of the wiring resistance of the signal lines, the pixel capacity and the like, and, hence, electric power necessary for the line inversion drive mode can be saved, whereby the power consumption can be suppressed.

With respect to the first display device PNL1 and the second display device PNL2, there is an embodiment in which the first display device PNL1 and the second display device PNL2 are mounted on equipment, such as a folding-type mobile telephone, a mobile terminal or the like, which is mechanically foldable at at least one portion using a bending portion as a boundary. In this case, it is possible to provide a state in which only the second display device PNL2 is arranged at a portion where the second display device PNL2 can be observed in a standby state and the first display device PNL1 is also observed during calling or mailing. Also, there is a case in which, in a state in which the equipment is folded, the second display device PNL2 is driven in the frame inversion mode; and, when the equipment is opened to produce a state in which the first display device PNL1 is observed, the first display device PNL1 is driven in the line inversion mode.

Figure 3:
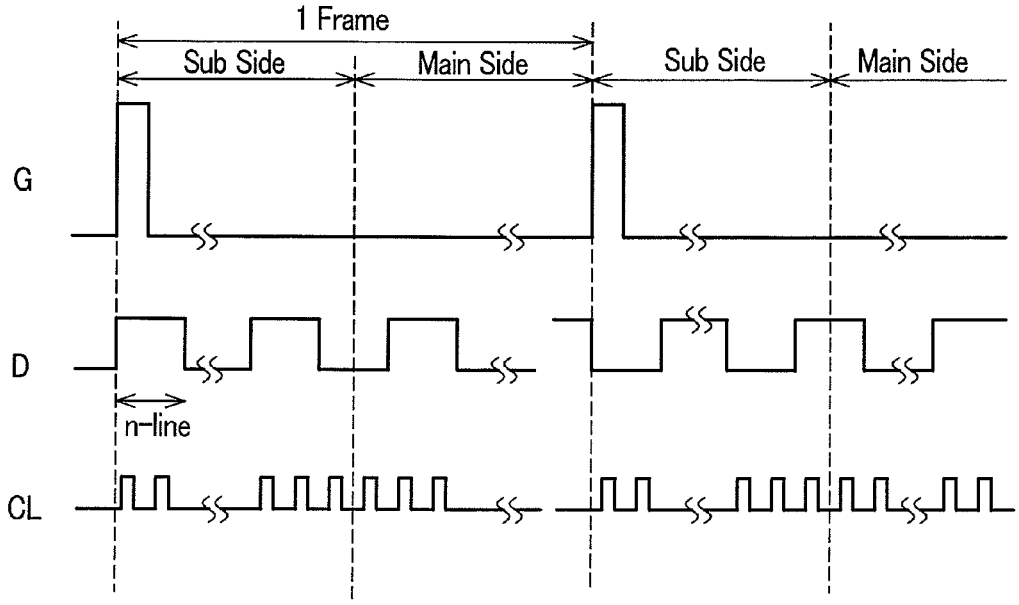
FIG. 3 is a waveform chart showing main signals outputted from the drive circuit in an N-line inversion drive mode in the embodiment of the present invention.

FIG. 3 is a waveform chart showing the main signals outputted from the drive circuit in the N-line inversion drive mode in the embodiment of the present invention. Reference symbols given to the waveforms in FIG. 3 are substantially the same as the reference symbols used in FIG. 2. In FIG. 3, when image display is performed using only the first display device PNL1, or when image display is performed using the first display device PNL1 and the second display device PNL2 simultaneously, the display is performed by inverting the polarity for every N-lines at the sub side and the main side. Here, N is 1 or more and is equal to or smaller than the number of signal lines DLs in the second display device PNL2. In an actual operation, it is preferable to set N to 1 line to several lines.

By adopting such drive modes, it is possible to suppress the vertical smear which is generated at a boundary between the signal lines which are used in common with the second display device PNL2 and the other signal lines on the screen at the first display device PNL1 side due to the influence of the wiring resistance, the pixel capacity and the like of the second display device PNL2, whereby an image display of high quality can be realized.

Command signals for making the above-mentioned first display device PNL1 and second display device PNL2 selectively display an image are configured such that, for example, when the present invention is applied to a screen-portion foldable mobile telephone having two screens, a switch which detects opening/closing of the screen portion is provided, a display mode selection signal is generated which allows only the second display mode to produce a display in a state where the screen portion is folded, and a signal is generated which allows the first display device and the second display device produce a display of different images simultaneously in a state where the screen portion is opened. Here, the display data to be displayed on the first display device PNL1 and the second display device PNL2 may be stored in such a way that the region of a frame memory is divided corresponding to the above-mentioned first display device PNL1 and second display device PNL2, or a memory which stores display data to be displayed on the second display device PNL2 may be provided separately from the frame memory.

Figure 4:
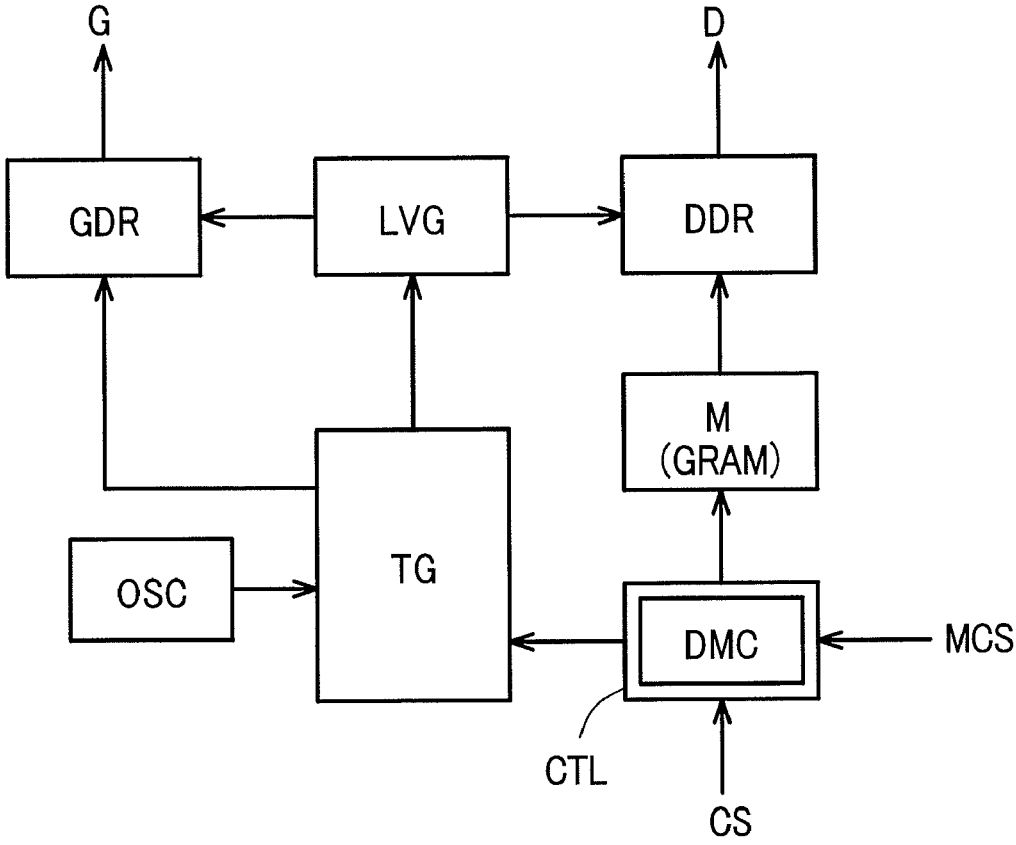
FIG. 4 is a block diagram showing an example of a control device used in the image display device of the present invention.

FIG. 4 is a block diagram showing an example of a control device for use in the image display device according to the present invention. In FIG. 4, reference symbol CTL indicates a display control device. The display control device CTL incorporates a display mode control circuit DMC therein which controls the display of the image display device by receiving various types of signals CS, such as display data from a central processing unit (CPU), which constitutes a system of an equipment to which the image display device is applied, and various types of timing signals, including a reference clock, as inputs. Reference symbol M indicates a graphic memory (GRAM: frame memory) which stores the display data from the central processing unit (CPU) therein. Reference symbol TG indicates a timing generating circuit which generates various types of timings necessary for the display using the first display device and the second display device based on the reference clock or the like inputted from the central processing unit (CPU), based on a reference frequency signal generated by an oscillation circuit OSC; LVG indicates a voltage generating circuit for driving the liquid crystal; GDR indicates a scanning line drive circuit; and DDR indicates a signal line drive circuit. Further, the reference signal G indicates a scanning line drive voltage output, and reference symbol D indicates a signal line drive voltage output; and, these outputs correspond to waveforms indicated by the same symbols in FIG. 2 and FIG. 3.

The display mode selection signal MCS, in the above-mentioned state in which the screen portion is folded, gives the command signals for driving the second display device in the frame inversion mode, as was explained in conjunction with FIG. 2, to the display mode control circuit DMC. Further, when the image is displayed using only the first display device, or when the image is displayed using the first display device and the second display device simultaneously in a state in which the screen portion is opened, the line inversion mode is selected. On the other hand, when the image is displayed using only the first display device in a state in which the screen portion is opened, this display can be realized by supplying a "black" signal to the second display device, or by separately providing a switch which stops the display of the second display device or the like.

Here, the display mode selection signal MCS may be inputted to the central processing unit (CPU), and this display mode selection signal is also applied to the display control device CTL along with various signals CS.

The display mode control circuit DMC sets a read-out address of the graphic memory M upon receiving the display mode selection signal MCS and outputs the display data corresponding to respective display modes to the signal line drive circuit DDR. On the other hand, the display mode control circuit DMC generates the timing signal in the frame inversion mode or the line inversion mode in the timing generating circuit TG in accordance with the selected display mode and gives a voltage level in the corresponding display mode to the scanning line drive circuit GDR and the voltage generating circuit LVG. The signal line drive circuit DDR supplies a given display voltage to the signal lines in response to the display data from the graphic memory GRAM and the voltage level from the voltage generating circuit LVG. Further, the scanning line drive circuit GDR supplies a given scanning voltage to the scanning lines in response to the timing signal from the timing generating circuit TG and the voltage level from the voltage generating circuit LVG.

In this manner, according to this embodiment, by integrating the signal line drive circuits for driving the first and the second display devices, respectively, into one signal line drive circuit, the constitution of the device can be simplified. Further, by adopting the frame inversion drive mode as the display mode in the second display device, which is constituted with the small number of signal lines, a low power consumption can be realized.

Figure 5:
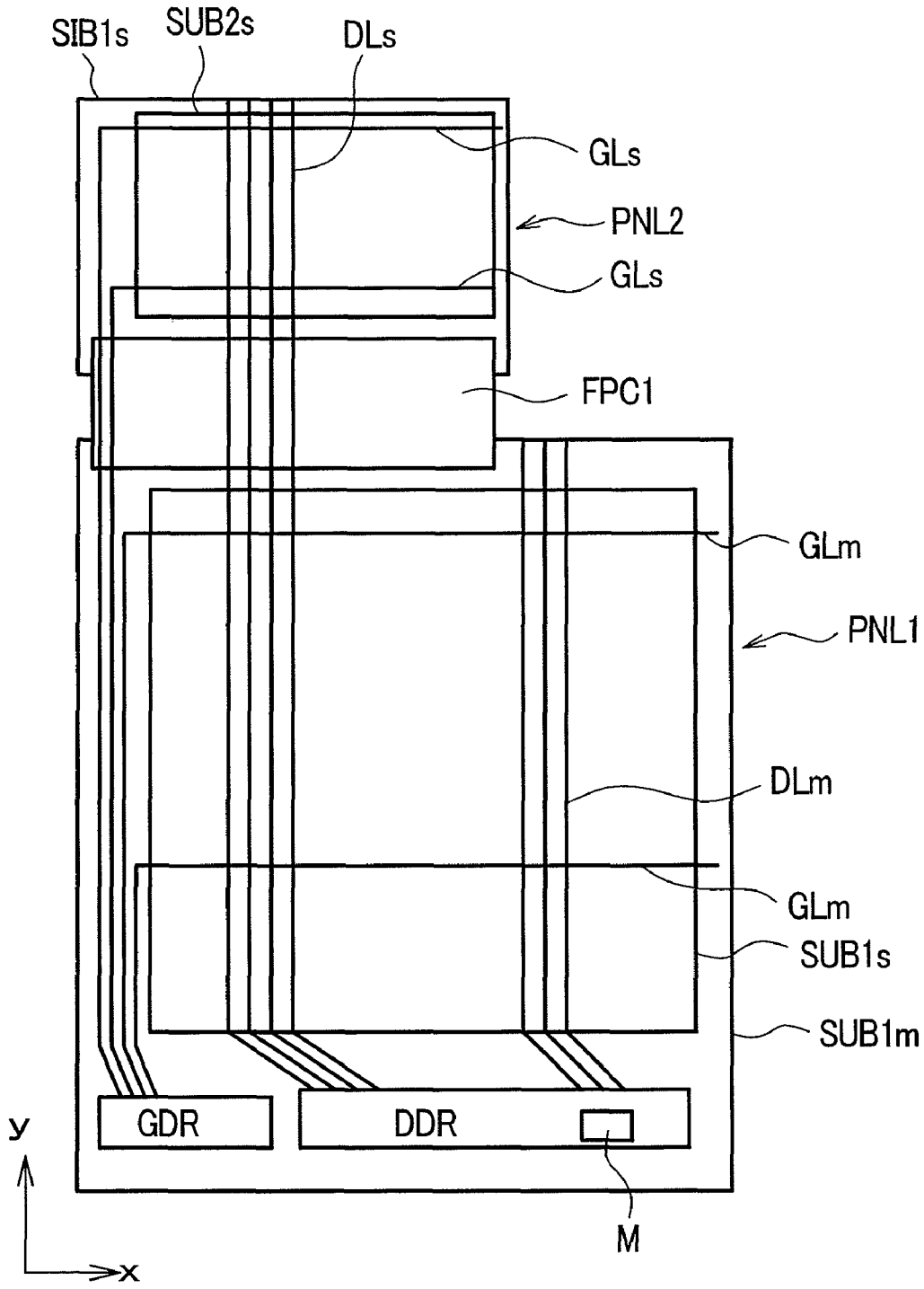
FIG. 5 is a plan view schematically illustrating the constitution of another embodiment of the image display device according to the present invention.

FIG. 5 is a plan view schematically illustrating the constitution of another embodiment of an image display device according to the present invention. In the drawing, reference symbols equal to those symbols in FIG. 1 correspond to identical functional portions. In the image display device that was explained in conjunction with FIG. 1, the scanning line drive circuit GDR is incorporated in the semiconductor chip in which the signal line drive circuit DDR is also incorporated. In this embodiment, however, the scanning line drive circuit GDR is mounted on the first substrate SUB1*m* of the first display device PNL1 as an independent semiconductor chip such that the scanning line drive circuit GDR is arranged in parallel with the signal line drive circuit DDR. The scanning lines from the scanning line drive circuit GDR are pulled around along one side in the y direction of the first substrate SUB1*m* of the first display device PNL1; and, thereafter, there are pulled around along one side in the y direction of the first substrate SUB1*s* of the second display device PNL2 by way of the flexible printed circuit board FPC1. Since the other elements and the manner of operations thereof are the same as those of the previous embodiments, a repeated explanation thereof is omitted.

Also, in this embodiment, by integrating the signal line drive circuits for driving the first and the second display devices, respectively, into one signal line drive circuit, the overall constitution can be simplified. Further, by adopting the frame inversion drive mode as the display mode in the second display device, which is constituted with the small number of signal lines, a low power consumption can be realized.

Figure 6:
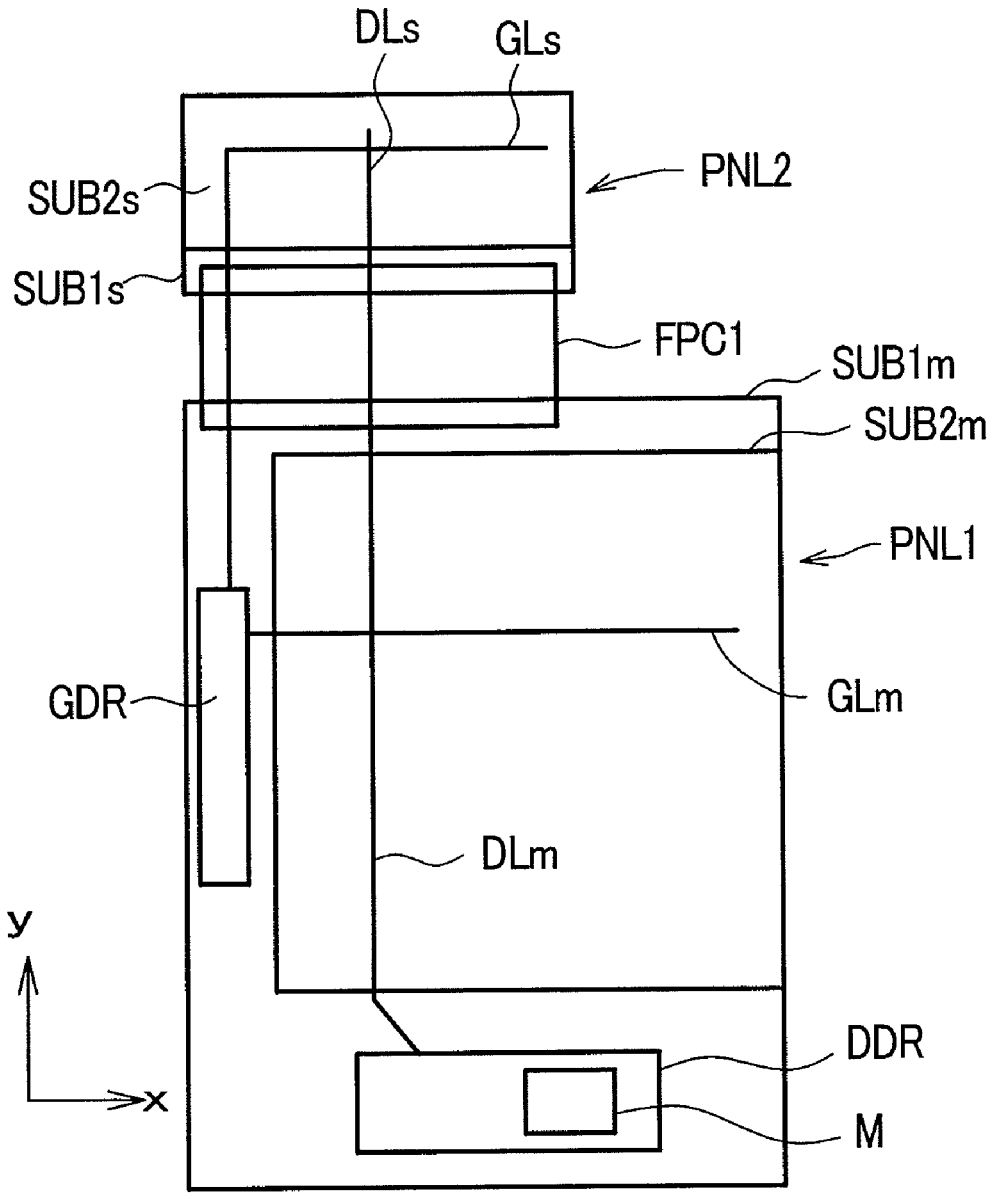
FIG. 6 is a plan view schematically illustrating the constitution of another embodiment of the image display device according to the present invention.

FIG. 6 is a plan view schematically illustrating the constitution of another embodiment of the image display device according to the present invention. In the drawing, reference symbols equal to those symbols in FIG. 1 correspond to identical functional portions. In this embodiment, the scanning line drive circuit GDR in FIG. 5 is mounted on one side in the y direction of the first substrate SUB1*m*, which constitutes the first display device PNL1. The scanning lines from the scanning line drive circuit GDR are pulled around along one side in the y direction of the first substrate SUB1*m* of the first display device PNL1; and, thereafter, there are pulled around along one side in the y direction of the first substrate SUB1*s* of the second display device PNL2 by way of the flexible printed circuit board FPC1. Since the other elements and the manner of operation thereof are the same as those of the previous embodiments, a repeated explanation thereof is omitted.

Also, in this embodiment, by integrating the signal line drive circuits for driving the first and the second display devices, respectively, into one signal line drive circuit, the overall constitution of the device can be simplified. Further, by adopting the frame inversion drive mode as the display mode in the second display device, which is constituted with the small number of signal lines, a low power consumption can be realized.

Figure 7:
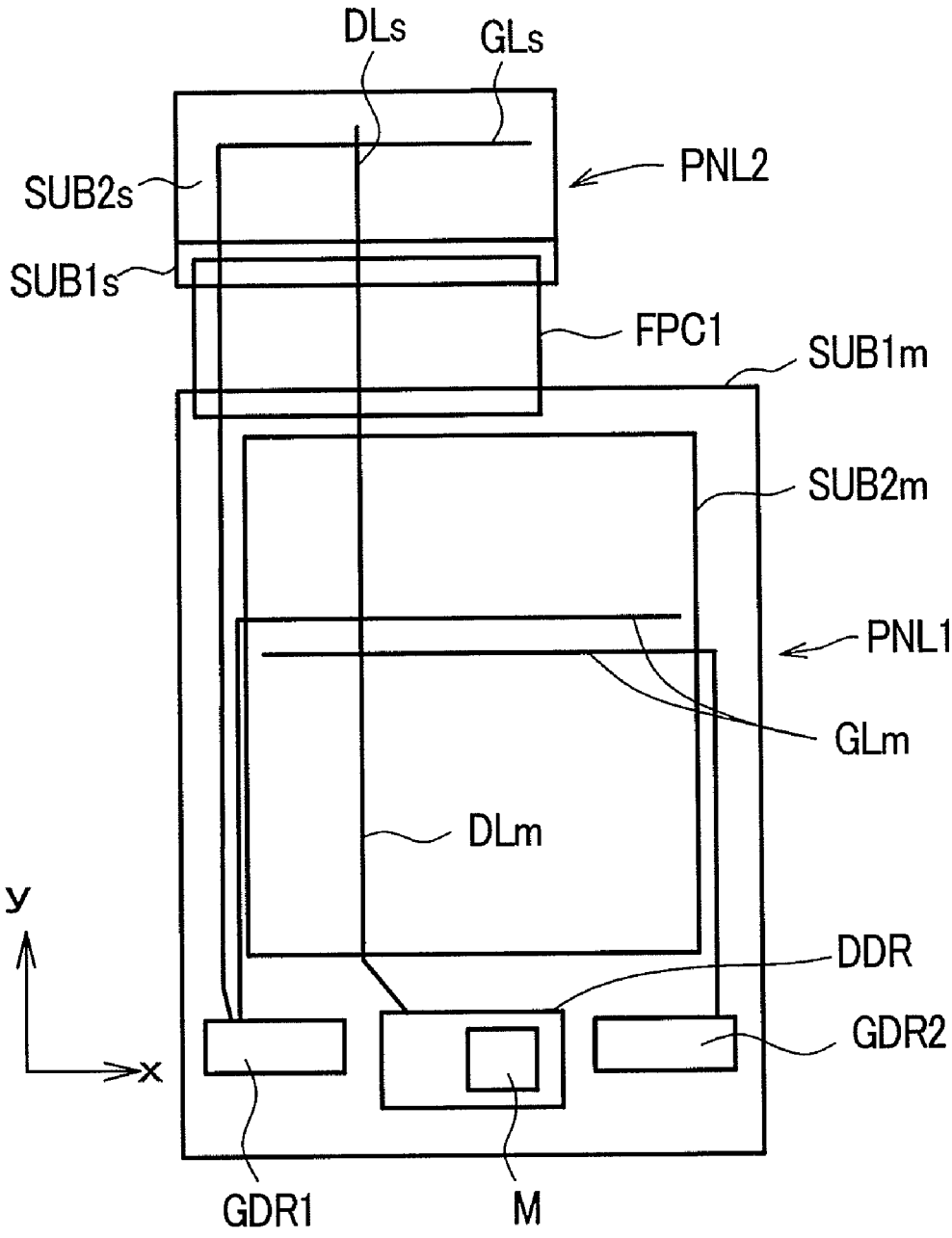
FIG. 7 is a plan view schematically illustrating the constitution of another embodiment of the image display device according to the present invention.

FIG. 7 is a plan view schematically illustrating the constitution of another embodiment of the image display device according to the present invention. In the drawing, reference symbols equal to those symbols in FIG. 1 correspond to identical functional portions. In this embodiment, the scanning line drive circuit GDR is divided into two driving circuits, consisting of a first scanning line drive circuit GDR1 and a second scanning line drive circuit GDR2, and these drive circuits are mounted on two opposing sides in the y direction of the first substrate SUB1*m* which constitutes the first display device PNL1. With respect to the first display device PNL1, the scanning lines from the first scanning line drive circuit GDR1 are pulled around along one side in the y direction of the first substrate SUB1*m* of the first display device PNL1, while the scanning lines from the second scanning line drive circuit GDR2 are pulled around along another side in the y direction of the first substrate SUB1*m* of the first display device PNL1. The scanning lines on the first display device PNL1 are formed alternately within the display region.

Further, the scanning lines provided to the second display device PNL2 are extended from the first scanning line drive circuit GDR1 and are pulled around one side in the y direction of the first substrate SUB1*s* of the second display device PNL2 by way of the flexible printed circuit board FPC1. Since the other elements and the manner of operation thereof are the same as those of the previous embodiments, a repeated explanation thereof is omitted.

According to this embodiment, by integrating the signal line drive circuits for driving the first and the second display devices, respectively, into one signal line drive circuit, the overall constitution of the device can be simplified. Further, by adopting the frame inversion drive mode as the display mode in the second display device, which is constituted with the small number of signal lines, a low power consumption can be realized. Still further, since the display region of the first display device PNL1 can be arranged at the center of the first substrate SUB1*m*, mounting the display region at the center of the display part of the equipment to which the liquid crystal display device of the present invention is applied can be facilitated.

Figure 8:
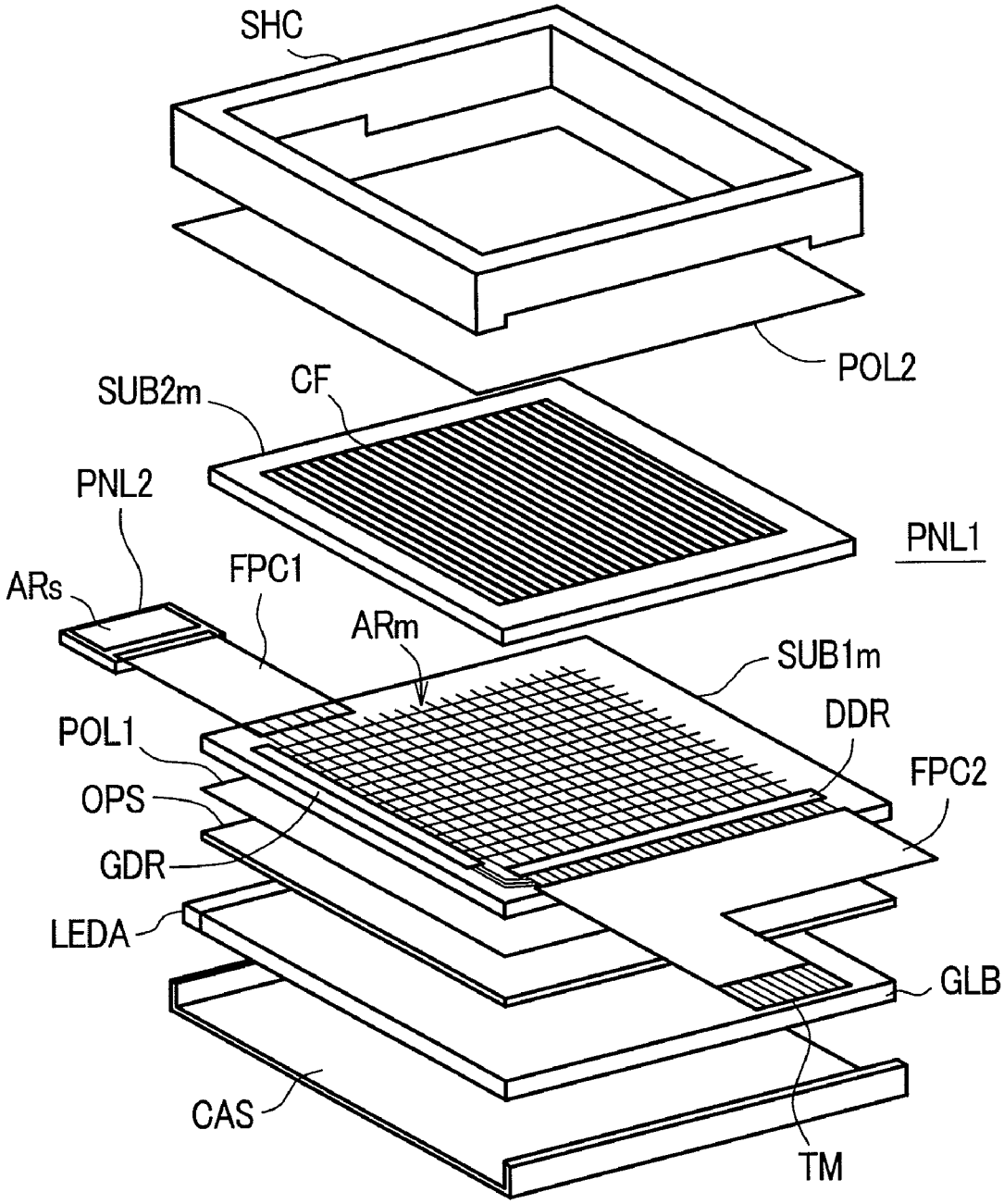
FIG. 8 is a developed perspective view illustrating a constitutional example of a liquid crystal display module using the liquid crystal display device according to the present invention.

FIG. 8 is a developed perspective view illustrating an example of a liquid crystal display module which uses the liquid crystal display device according to the present invention.

The liquid crystal display device used in this liquid crystal display module corresponds to the liquid crystal display device which has been explained in conjunction with FIG. 6. In FIG. 8, on the first substrate SUB1*m* of the first display device PNL1, a main display region Arm is provided, which is constituted of a plurality of pixels having thin film transistors connected to intersecting portions of the scanning lines and signal lines. Further, the scanning signal line drive circuit GDR and the signal line drive circuit DDR are formed on the first substrate SUB1*m*. On a main surface (inner surface) of the second substrate SUB2*m* of the first display device PNL1, color filters CF and common electrodes (not shown in the drawing) are formed. Then, a liquid crystal layer is sealed between the first substrate SUB1*m* and the second substrate SUB1*s*. Further, a first polarizer POL1 and an optical compensation sheet OPS, which is constituted of a diffusion sheet or a prism sheet, are mounted on a back surface of the first substrate SUB1*m*. Further, a polarizer POL2 is also mounted on an upper surface of the second substrate SUB2*m*.

The above-mentioned scanning line drive circuit GDR and signal line drive circuit DDR are mounted on peripheral sides of the first substrate SUB1*m*; one end of the flexible printed circuit board FPC2 is connected to the side of the first substrate SUB1*m* on which the signal line drive circuit DDR is mounted; and the other terminal TM is connected to an external signal source, such as a central processing unit or the like (not shown in the drawing). On a back surface of the optical compensation sheet OPS, an illumination device (backlight), which is constituted of a light source, such as a light emitting diode LEDA or the like, and a light guide plate GLB is arranged. These elements are integrally formed with a lower casing CAS and an upper casing SHC, thus constituting the liquid crystal display module.

On the other hand, the second display device PNL2 is connected to one side of the first display device PNL1 by way of the flexible printed circuit board FPC1. The structure of the second display device PNL2 is substantially the same as the structure of the main panel PNL1, wherein a plurality of pixels having thin film transistors are provided to intersecting portions of the scanning lines and the signal lines thus, forming a sub display region ARs. This second display device PNL2 need not be provided with a full color display, which is provided for the first display device; thus, a monochromatic display may be provided as the second display device PNL2. Further, the scanning lines and the signal lines are constituted as has been explained in conjunction with the above-mentioned embodiments. Although the liquid crystal display module having such a constitution can be used as the display means of a mobile telephone or a portable information terminal, the liquid crystal display module is applicable to any electronic equipment having a so-called two screen display.

Figure 9:
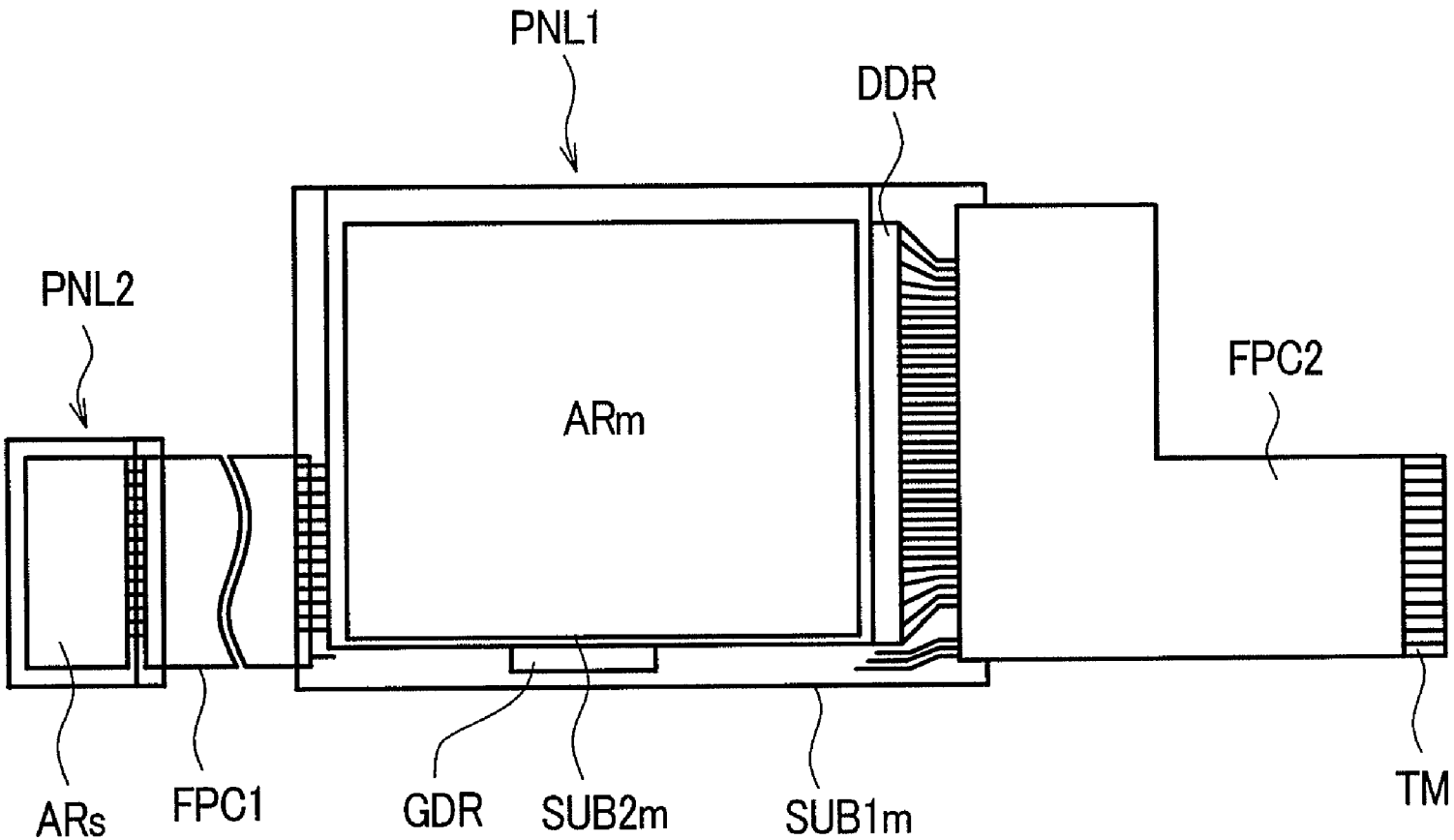
FIG. 9 is a plan view showing an example of the appearance of a liquid crystal display module using the liquid crystal display device according to the present invention.

FIG. 9 is a plan view showing an example of the appearance of the liquid crystal display module which uses the liquid crystal display device according to the present invention in a state in which the liquid crystal display module is assembled in a developed form as explained in conjunction with FIG. 8. The first display device PNL1 is formed of the first substrate SUB1*m* and the second substrate SUB2*m*, and the scanning line drive circuit GDR and the signal line drive circuit DDR, which are constituted of the semiconductor chips, are mounted on the periphery of the main display region ARm. Electronic components, such as HA resisters, capacitors and the like, and a power source circuit chip may be mounted on the flexible printed circuit board FPC2.

The second display device PNL2 is connected to the first display device PNL1 by way of the flexible printed circuit board FPC1, as was explained in conjunction with the above-mentioned embodiments. The second display device PNL2 can be used in such a way that, for example, the second display device PNL2 is used for simple data display, such as a standby display, a clock display or a mail reception display in a mobile telephone which uses the first display device PNL1 as a main display screen. In the above-mentioned embodiments, the signal lines of the second display device, which are small in number, are used as extensions of a portion which is offset at one side of an integral region of the first display device. However, the present invention is not limited to such an arrangement, and the signal lines which are disposed at a region located at the center portion of the first display device may be extended to the second display device. Further, it is possible to provide the image display device having the two screen displays by forming the first display device and the second display device on the same substrate. In this case, the flexible printed circuit board which connects the two display devices in respective embodiments becomes unnecessary.

Although an explanation has been made using a liquid crystal display device as an example in the above-mentioned embodiments, the present invention is not limited to a liquid crystal display device, but is also applicable to an organic EL display device which displays images using a pixel selection method similar to the pixel selection method of the liquid crystal display device and other active matrix type display device.

As has been explained heretofore, according to the present invention, in the image display device which drives two display devices which differ in the number of signal lines thereof using a common drive circuit, it is possible to suppress the vertical smear which is generated on the display device having the larger number of signal lines when the two display devices perform a display of images alternatively or simultaneously, whereby it is possible to provide an image display device which enables the generation of an image display of high quality and realizes a low power consumption.

The invention claimed is:

1. An image display device comprising:

a first display panel including a substrate having a plurality of first scanning lines, a plurality of first signal lines which intersect the plurality of first scanning lines, and a plurality of first switching elements each of which is arranged corresponding to each intersecting portion of the plurality of first scanning lines and the plurality of first signal lines;

a second display panel including another substrate having a plurality of second scanning lines, a plurality of second signal lines which intersect the plurality of second scanning lines, and a plurality of second switching elements each of which is arranged corresponding to each intersecting portion of the plurality of second scanning lines and the plurality of second signal lines; and a flexible printed circuit board connecting the first display panel with the second display panel;

wherein the image display device drives the first display panel in a line inversion mode when only the first display panel displays images;

wherein the image display device drives the second display panel in a frame inversion mode when only the second display panel displays images; and wherein the image display device drives the first display panel and the second display panel in the line inversion mode when both of the first display panel and the second display panel display images.

2. An image display device according to claim 1, wherein a number of the plurality of second signal lines of the second display panel is smaller than a number of the plurality of first signal lines of the first display panel.

3. An image display device according to claim 2, wherein a number of the plurality of second scanning lines of the second display panel is smaller than a number of the plurality of first scanning lines of the first display panel.

4. An image display device according to claim 1, wherein a number of the plurality of second scanning lines of the second display panel is smaller than a number of the plurality of first scanning lines of the first display panel.

5. An image display device according to claim 1, wherein each of the plurality of second signal lines of the second display panel is electrically connected with a corresponding one of the plurality of first signal lines of the first display panel by way of the flexible printed circuit board.

6. An image display device according to claim 5, wherein the image display device includes a signal line driver which supplies a video signal to the plurality of first signal lines and the plurality of second signal lines.

7. An image display device according to claim 1, wherein the image display device includes:

a scanning line driver which supplies a scanning signal to the plurality of first scanning lines and the plurality of second scanning lines;

a signal line driver which supplies a video signal to the plurality of first signal lines and the plurality of second signal lines; and a display control device which controls display operations of the first display panel and the second display panel.

8. An image display device according to claim 1, wherein the image display device includes a display mode control circuit which changes between driving the second display panel in the line inversion mode and driving the second display panel in the frame inversion mode.

* * * * *